US006272707B1

(12) United States Patent
Robrecht et al.

(10) Patent No.: US 6,272,707 B1
(45) Date of Patent: Aug. 14, 2001

(54) SUPPORT PAD

(75) Inventors: Thomas J. Robrecht, Enka, NC (US); Harold Ward; Donald D. Farnsworth, both of San Diego, CA (US)

(73) Assignee: Colbond Inc., Enka, NC (US)

( * ) Notice: Subject to any disclaimer, the term of this patent is extended or adjusted under 35 U.S.C. 154(b) by 0 days.

(21) Appl. No.: 09/190,609

(22) Filed: Nov. 12, 1998

(51) Int. Cl.[7] ..... A47C 27/12

(52) U.S. Cl. ..... 5/724; 5/484; 5/690; 5/691; 5/736; 5/652.1; 5/731

(58) Field of Search ..... 5/724, 690, 484, 5/691, 736, 731, 652.1, 652.2, 726, 490, 738

(56) References Cited

U.S. PATENT DOCUMENTS

| | | | | |
|---|---|---|---|---|
| Re. 31,599 | | 6/1984 | Rasen et al. | 156/167 |
| 3,653,083 | | 4/1972 | Lapidus . | |
| 3,888,244 | | 6/1975 | Lebold . | |
| 4,212,692 | | 7/1980 | Rasen et al. | 156/167 |
| 4,252,590 | | 2/1981 | Rasen et al. | 156/167 |
| 4,342,807 | | 8/1982 | Rasen et al. | 428/180 |
| 4,693,239 | | 9/1987 | Clover Jr. | 128/80 F |
| 5,107,825 | | 4/1992 | Bass, Jr. | 602/24 |
| 5,189,743 | * | 3/1993 | Diflor | 5/653 |
| 5,249,320 | | 10/1993 | Moretz et al. | 5/484 |
| 5,316,544 | | 5/1994 | McAninch | 602/5 |
| 5,501,891 | | 3/1996 | Saika et al. | 5/652.1 |
| 5,638,558 | | 6/1997 | Moore | 5/925 |
| 5,677,036 | | 10/1997 | Kording | 5/730 |
| 5,731,062 | * | 3/1998 | Kim et al. | 428/175 |
| 5,826,288 | * | 10/1998 | Ecer | 5/724 |
| 5,870,785 | * | 2/1999 | Hoorins | 5/724 |
| 6,131,220 | * | 10/2000 | Morimura | 5/652.1 |

FOREIGN PATENT DOCUMENTS

| | | | | |
|---|---|---|---|---|
| 9664225 | | 2/1997 | (AU) . | |
| 4439088 A1 | * | 5/1996 | (DE) . | |
| 19516880 A1 | | 11/1996 | (DE) . | |
| 19633318 C1 | * | 1/1998 | (DE) . | |
| 29722303 U1 | | 2/1998 | (DE) . | |
| 107695 | * | 6/1965 | (DK) | 5/716 |
| 90196 B | * | 9/1993 | (FI) . | |
| 2302196 A | * | 10/1976 | (FR) . | |
| 1341325-R | | 12/1973 | (GB) . | |
| 2284348 A | * | 6/1995 | (GB) . | |
| 2311217 A | * | 9/1997 | (GB) | 5/731 |
| 2312162 A | * | 10/1997 | (GB) . | |
| 2314506 A | * | 1/1998 | (GB) | 5/630 |
| 405003894A | * | 1/1993 | (JP) | 5/724 |
| 9271483 A | * | 10/1997 | (JP) . | |
| WO 9500052 A1 | * | 1/1995 | (WO) . | |
| WO 9632526 A1 | * | 4/1995 | (WO) . | |
| WO 9812047 A1 | | 3/1998 | (WO) . | |
| WO 9814646 | | 4/1998 | (WO) . | |

* cited by examiner

*Primary Examiner*—Alexander Grosz
(74) *Attorney, Agent, or Firm*—Oliff & Berridge, PLC

(57) ABSTRACT

A support pad includes a low density layer of an air and water permeable three-dimensional matrix composed of a mat of polymeric material. The layer preferably has a smooth and planar contour on the top face, and a "peak and valley" contour on the bottom face. A pad may be maintained over the top face of the low density layer. Sheeting may be placed over at least the top face of the low density layer and the pad to provide a more comfortable surface for an individual to rest upon.

22 Claims, 2 Drawing Sheets

SUPPORT PAD

BACKGROUND OF THE INVENTION

This invention relates to a mattress-type support pad, and more particularly, to a support pad including a layer of an air and liquid permeable three dimensional matrix of polymeric material.

Recently, health concerns have led hospitals to cover bed mattresses with liquid impermeable vinyl covers which can be easily washed and disinfected. Conventional sheets are typically used over the vinyl-covered mattresses. Bed-ridden individuals, including individuals suffering from skin ulcers and/or open sores, are often forced to spend extended periods of time on sheets which have become soaked with wetness. Since the damp sheets are positioned over liquid impermeable vinyl, the dampness remains trapped inside the sheeting, between an individual's body and the vinyl cover. Simple incontinence pads, usually paper bonded to impermeable plastic, hold perspiration and body fluids in an uncomfortable and possibly harmful proximity to the individual's body.

The known mattress pads suffer from the inability to allow for efficient drainage and/or evaporation of patients' perspiration from the sheeting, often leading to severe patient discomfort in the form of bed sores or, possibly, decubitus ulcers.

Thus, there exists a need for an improved mattress pad which includes the desirable properties of permitting drainage and/or evaporation of perspiration entering into the pad and also permitting air to permeate in order to hasten such evaporation.

In disparate fields of art, there are known materials composed of low density matted thermoplastic macrofilaments irregularly looped and intermingled in highly porous and/or open peak and valley three-dimensional sheet structures. Such materials are disclosed, for example, in U.S. Pat. Nos. 4,212,692; 4,252,590; and Re. 31,599; the contents of each of which are hereby incorporated herein by reference. One application of these materials has been as soil retention matting for use in the building industry. Similar materials have been used as seat cushions in marine environments.

SUMMARY OF THE INVENTION

The support pad of the present invention includes a layer of a low density liquid and air permeable three-dimensional matrix of matted polymeric material. The pad is preferably covered with a non-foamed pad and used with conventional or modified bed sheeting. The pad is preferably made in standard bed sizes, e.g. single, double, queen, king, California king size, examination table size, labor and delivery table size, crib size, gurney size, etc. In an alternative embodiment, the pad includes one or more hinged sections for use on mechanically bending beds. The layer of low density material, after removal of the pad and the sheets, may be cleaned, disinfected and reused many times. However, since the materials used in the layer are relatively inexpensive, it is also possible to dispose of the layer after a single use or after repeated uses by a single person, for example. The layer of material for the pad is chosen for its ability to admit moisture into the matting from the sheet above and also to admit air to enter and permeate into and out of the matting in order to hasten evaporation of the moisture contained within the pad and in the sheeting above the pad.

DETAILED DESCRIPTION OF PREFERRED EMBODIMENTS

The present invention is a support pad which includes a layer of a low density air and liquid water permeable three-dimensional matrix made from a matting of polymeric material.

Figure 1:
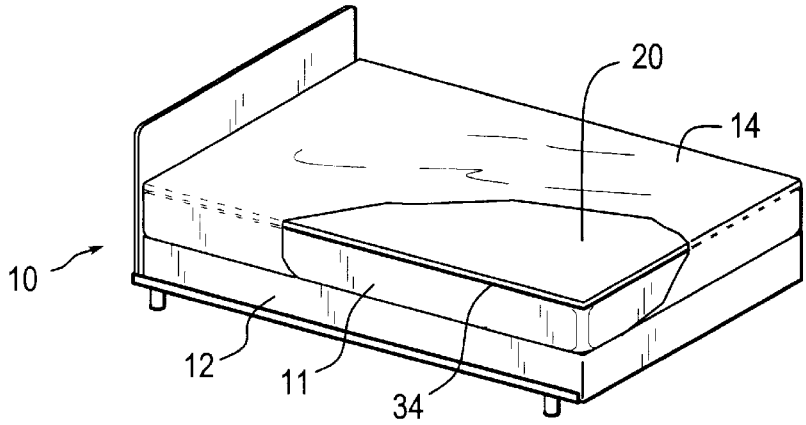
FIG. 1 is a perspective view showing a conventional bed over which is a preferred embodiment of a mattress pad in accordance with the present invention.

FIG. 1 shows a conventional bed 10, including mattress 11 and box springs 12, over which is the mattress pad 20 in accordance with the present invention. Conventional sheeting 14 is preferably utilized over the pad 20. Waterproof sheeting or the like can preferably be located under the pad 20 to protect mattress 11.

Figure 2:
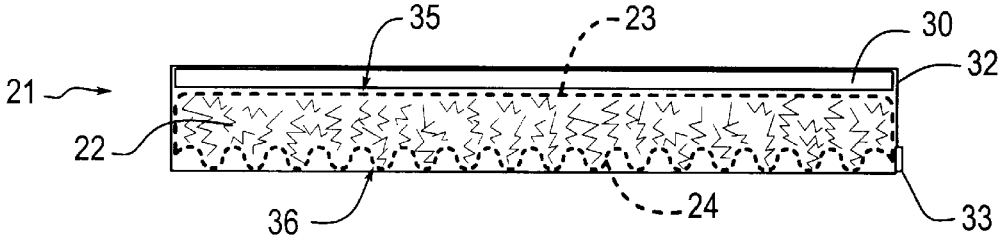
FIG. 2 is a cut-away view of a support pad system in accordance with the present invention.

A preferred embodiment of a mattress pad in accordance with the present invention is shown in FIG. 2 and is generally designated by reference numeral 21. The pad 21 includes a layer 22 of a low density air and liquid water permeable three-dimensional matrix made from a matted polymeric material. The layer 22 preferably has a substantially planar contour 23 on one face or surface 35 and a peak and valley or rolling contour 24 on the opposite face or surface 36. While the contours are represented by dashed lines, the matted polymeric material features numerous air passages between and around fibers for admitting air and moisture into the material throughout the contours 23 and 24 of both faces 35 and 36.

The matted polymeric material provides a cushioning effect to an individual resting on the mat. However, additional cushioning may be provided by an optional cushion pad 30, which is preferably composed of a material so as not to retain substantial amounts of fluids entering from above, but to allow most or all of such fluids to pass through into the layer 22 below. The material may be, for example, polyester or polypropylene material, cotton, or a blended material. The cushion pad 30 may be adhered to the top surface of the layer 22 or may be removable.

The layer 22 and optional cushion pad 30 may be covered with an optional and preferably removable outer cover 32. The outer cover 32 preferably includes a fastener 33 to maintain it in position around the layer 22 and pad 30. The fastener 33 may be, for example, a zipper, an elastic strip, or mating pieces of hook and loop material. The outer cover may be, for example, a fabric or non-fabric material encapsulating the layer 22 and optional cushion pad 30. Alternatively, the outer cover 32 could be conventional bed sheeting.

Figure 3:
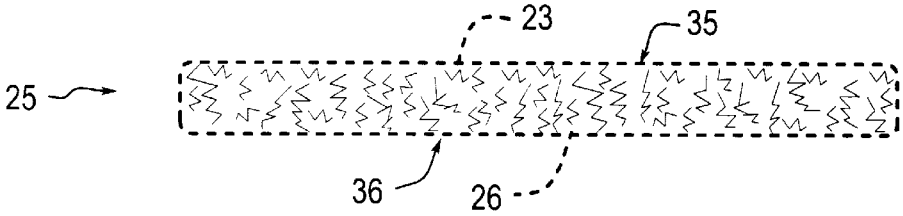
FIG. 3 is a cut-away view of an embodiment of a support pad in accordance with the present invention.

FIG. 3 shows an alternative pad 25 of the invention. The alternative pad 25 includes a substantially planar profile or contour 23 on the top face 35 in the same fashion as the first embodiment, but also includes a substantially planar profile or contour 26 on the bottom face 36. The pad 25 may be used alone as shown or included with a pad 30 and outer cover 32 as shown for the first embodiment.

Figure 4:
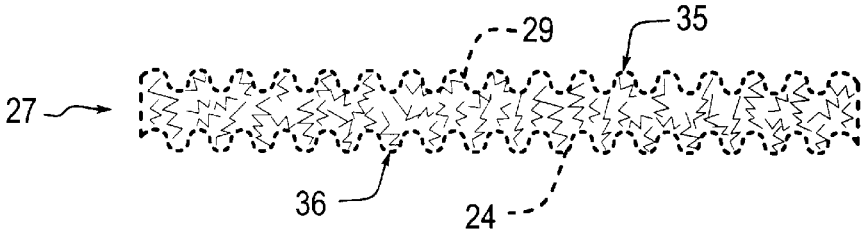
FIG. 4 is a cut-away view of another embodiment of a support pad in accordance with the present invention.

FIG. 4 shows an alternative pad 27 of the invention. The alternative pad 27 includes a peak and valley profile or contour 29 on the top face 35, and a peak and valley profile or contour 24 on the bottom face 36. The pad 27 may be used alone as shown or included with a pad 30 and outer cover 32 as shown for the first embodiment.

Figure 5:
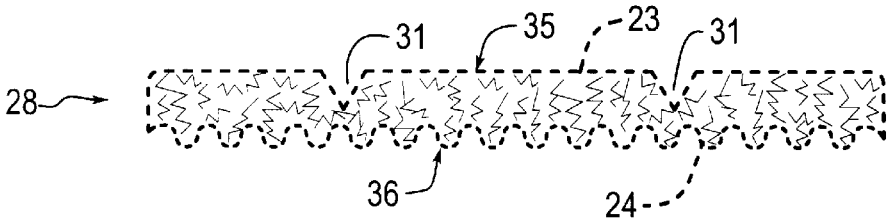
FIG. 5 is a cut-away view of another embodiment of a support pad in accordance with the present invention.
Figure 6:
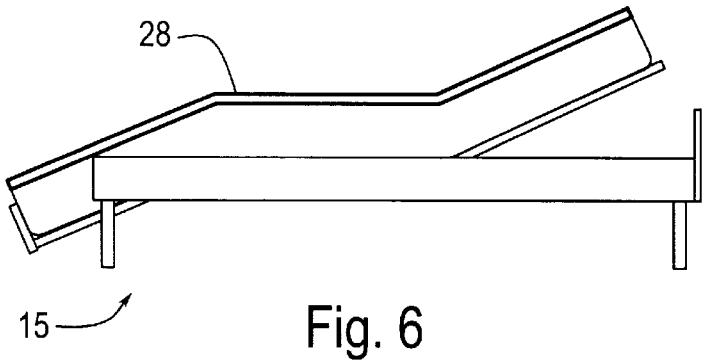
FIG. 6 is a side view showing a conventional folding bed over which is an embodiment of a mattress pad in accordance with the present invention.

FIG. 5 shows another alternative pad 28 of the invention. The alternative pad 28 includes a substantially planar profile or contour 23 on the top surface in the same fashion as the first embodiment, and a peak and valley contour 24 on the bottom surface, but also includes hinged areas 31 to enable bending of sections of the pad 28. The hinged areas 31 enable use of the pad 28, for example, on a hospital-type bed 15 of the type which is mechanically able to bend to various positions for the comfort of the patient, as illustrated in FIG. 6. The hinges may be slots or creases running through the material as illustrated in FIG. 5, although numerous other types of hinges may be used. For example, two sections of material can be simply attached together with a strip of material adhesively attached to both sections. Again, the pad 25 may be used alone, as shown, or included with a pad 30 and removable outer cover 32 as shown for the first embodiment.

An optional drip collector 34, as illustrated in FIG. 1, may be included to collect any liquids passing through the pads 20, 21, 25, 27, or 28. Such a drip collector 34, which may be an absorbent material or a pan type structure, is particularly suitable for use in a situation where the underlying bed is not covered by a liquid impermeable, e.g., plastic, cover.

Examples of three-dimensional matrix materials that may be utilized for the layer of air and liquid water permeable three-dimensional matrix of the present invention include, but are not limited to, ENKAMAT® and ENKADRAIN®, which are manufactured by Akzo Nobel Geosynthetics Company of Enka, N.C. U.S. Pat. Nos. 4,212,692; 4,252,590; and Re. 31,599; the entire contents of each of which are hereby incorporated herein by reference, disclose three-dimensional matrices that may be used for the layer of air and liquid water permeable three-dimensional matrix of the present invention. These patents generally disclose thermoplastic microfilaments irregularly looped and intermingled in a highly porous or open, preferably peak and valley, three-dimensional sheet structure. As disclosed in U.S. Pat. Nos. 4,212,692; 4,252,590; and Re. 31,599, the matting may be formed of continuous polymer filaments self-bonded at interstices of the filaments. The interstices are randomly arranged throughout the matrix. Especially preferred materials are ENKAMAT® 7210, which has a thickness of about 7 mm and a weight of about 7.7 ounces/square yard and ENKAMAT® 7220, which has a thickness of about 16 mm and a weight of about 11.8 ounces /square yard. These materials are three-dimensional geomatrices of heavy nylon monofilaments fused at their intersections. About 95% of the geomatrix is open. The polymeric material is nylon 6 containing about two percent carbon black.

The pads 20, 21, 25, 27 and/or 28 are preferably made of a size sufficient to substantially cover a standard size bed mattress 11, e.g. single, twin (about thirty-nine inches by about seventy-five inches), full (about fifty-four inches by about seventy-five inches), double, queen (about sixty inches by about eighty inches), king (about seventy-two inches by about eighty inches), California king, examination table, labor and delivery table, gurney, etc. One preferred size of pad is about 6.5 feet in length by about thirty-nine inches in side-to-side width. The thickness of the layer 22 is preferably greater than about 5 mm and preferably about 5 mm to about 50 mm, more preferably between about 5 mm to about 20 mm, and still more preferably between about 7 mm to about 16 mm. The matted polymeric material is preferably composed of nylon material, although other polymeric materials, including but not limited to polyesters, may also be effectively used.

The mattress pad of the invention is particularly suitable for use in hospital, other medical environments, and the home, or wherever it is necessary for patients to spend extended periods of time in bed. When a patient rests atop the mattress pad of the present invention, perspiration and other fluids are absorbed into the bed sheeting material. The layer of polymeric mat used in the present invention provides a path for moisture to drain from the sheeting, a path for air to enter to enable evaporation of moisture contained within the mattress pad, and also a path to enable the evaporation of moisture that remains absorbed in the sheeting.

The mattress pad of the invention may be used in combination with basic nursing, which dictates that a patient have clean and dry skin with a clean and dry bed. For optimal health, a patient's skin is preferably inspected four times per day, for example, at seven a.m., noon, three p.m., and prior to sleeping. Use of the mattress pad of the invention may increase the amount of time before it is necessary to clean the patient's bed. Temperature control of the forced air may permit the bed to be rapidly warmed or cooled.

Figure 7:
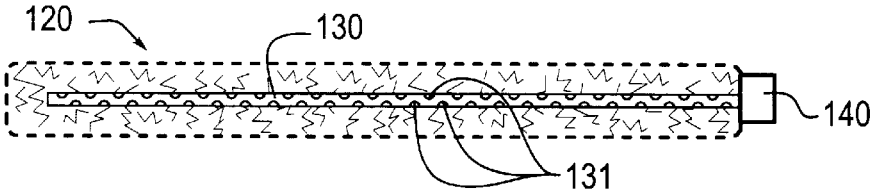
FIG. 7 is a cut-away view of another embodiment of a mattress pad with an air moving device in accordance with the present invention.

FIG. 7 shows an alternative pad 120 featuring an air moving device 140. The air moving device 140 may be, for example, a pump for pumping air through the pad 120 or a vacuum system for pulling air through the pad 120. Tubules 130 may be attached to the air moving device 140 with openings 131 for directing air flow to or from specific areas under a patient's body, such as for example, under the buttocks, femoral, occipital and back regions. The forced air flow may increase the evaporation of perspiration and other dampness, and also may provide a pleasant cooling effect to the patient's body.

Figure 8:
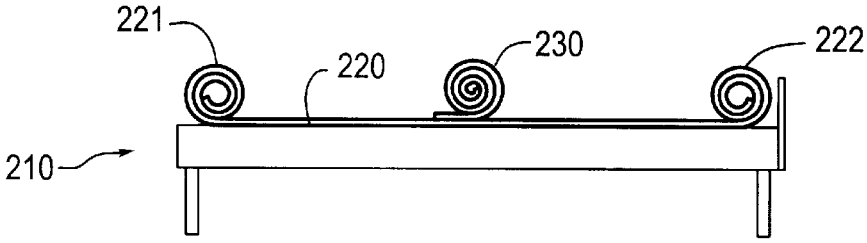
FIG. 8 is a side view showing a conventional bed over which are embodiments of mattress pads in accordance with the present invention.

Another aspect of the invention is illustrated in FIG. 8, which shows a conventional bed 210, over which is a first pad 220 which has been partially rolled up at each of the ends 221 and 222. At one end 221 or 222 of the mat 220, a patient (not shown) can elevate, for example, their calves just above their ankles to help prevent their heels and ankles from touching the bed 210. This may help to prevent the occurrence of decubitous ulcers on the heels and ankles. At the opposite end 222 or 221 of the mat 220, the patient can elevate their head. It is also possible to only roll up one end 221 or 222 of the mat. Rolling an end of the mat up provides for increased air space underneath a patient which allows for additional air flow within the mat for regulation of moisture, comfort, temperature and odor regulation.

Additional mats, such as for example mat 230, may optionally be rolled up and positioned under a patient's back, particularly in situations where the patient is resting on their side.

While it is preferred to include a single layer of matted polymeric material, it is within the scope of the present invention to include additional layers of polymeric material and other materials as may be desired to increase the comfort of the pad, or for any other reason. Similarly, other changes and embodiments of the invention and combinations of the above embodiments are possible and the scope of the invention should be considered to encompass all possible embodiments of the invention as broadly disclosed, and any and all equivalents thereof.

What is claimed is:

1. A bedding system comprising:

a first layer, about 7 mm to about 20 mm thick, of matting composed of an air and liquid water permeable three-dimensional matrix of a polymeric material in a size suitable to substantially cover a standard size bed mattress, said matrix having a peak and valley surface on one face and a substantially planar surface on the opposite face;

a second layer of a non-foam pad material maintained atop the substantially planar surface of said first layer;

a removable and replaceable outer fabric material over said first layer and said second layer; and a set of bed sheeting over said removable outer fabric material cover.

2. The system of claim 1, wherein the support pad is hinged to allow the support pad to bend when used on bending beds.

3. The system of claim 1, further comprising a drip container under said first layer to collect liquid passing through said layer.

4. The system of claim 1, further comprising an air moving device for moving air within the first layer.

5. The system of claim 4, wherein said air moving device is an air pump for pumping air into the first layer or a vacuum source for pulling air out of the first layer.

6. The system of claim 4, further comprising a tube system for directing air between the air moving device and at least one specific area within the first layer.

7. The system of claim 1, wherein the matrix includes a plurality of continuous polymer filaments irregularly looped and intermingled in a highly porous, open three dimensional structure and self-bonded at interstices of the filaments.

8. The system of claim 7, wherein more than 95% of the matrix is open space.

9. A support pad for bedding, comprising:

a first layer, about 5 mm to about 50 mm thick, of matting composed of an air and liquid water permeable three-dimensional matrix of a polymeric material, wherein said matrix has two surfaces, at least one of which has a peak and valley contour or profile;

a second layer of a pad material maintained atop the surface of the first layer; and a removable outer fabric material over said first and second layer.

10. The support pad of claim 9, wherein the support pad is hinged to allow the support pad to bend when used on bending beds.

11. The support pad of claim 9, further comprising a drip container under said first layer to collect liquid passing through said layer.

12. The support pad of claim 9, further comprising an air moving device for moving air within the first layer.

13. The support pad of claim 12, wherein the air moving device is an air pump for pumping air into the first layer or a vacuum source for pulling the air out of the first layer.

14. The support pad of claim 12, further comprising a tube system for directing air between the air moving device and at least one specific area within the first layer.

15. The support pad of claim 9, wherein the matrix includes a plurality of continuous polymer filaments irregularly looped and intermingled in a highly porous, open three-dimensional structure and self-bonded at interstices of the filaments.

16. The support pad of claim 15, wherein more than about 95% of the matrix is open space.

17. The support pad of claim 9, wherein said first layer has a top face which is substantially planar in contour.

18. The support pad of claim 9, wherein said first layer has a bottom face having a substantially planar contour.

19. The support pad of claim 9, wherein said polymeric material is selected from the group from consisting of nylon and polyester.

20. The support pad of claim 9, wherein said first layer has a thickness of from about 7 mm to about 20 mm.

21. The support pad of claim 9, wherein said removable outer fabric material includes a fastener which may be unfastened to allow access to the matting layer from outside of the cover.

22. The support pad of claim 9, wherein the matting is sized to substantially cover a bed mattress of a size selected from the group consisting of single bed size, twin bed size, double bed size, full bed size, queen bed size, king bed size, California king size, examination table size, labor and delivery table size and gurney size.

* * * * *